US006764036B2

(12) United States Patent
Okuya

(10) Patent No.: US 6,764,036 B2
(45) Date of Patent: Jul. 20, 2004

(54) CRUSHING-BREAKING METHOD OF CASTING PRODUCTS, CUTTER STRUCTURE USED FOR THE METHOD AND CRUSHING-BREAKING APPARATUS OF CASTING PRODUCTS

(76) Inventor: Yasuaki Okuya, 52, Soramachi, Heisaka-Cho, Nishio-City, Aichi-Pref. (JP)

( * ) Notice: Subject to any disclaimer, the term of this patent is extended or adjusted under 35 U.S.C. 154(b) by 260 days.

(21) Appl. No.: 09/977,575

(22) Filed: Oct. 16, 2001

(65) Prior Publication Data

US 2002/0125351 A1 Sep. 12, 2002

(30) Foreign Application Priority Data

Feb. 1, 2001 (JP) ..... 2001-025611
Jun. 1, 2001 (JP) ..... 2001-166836

(51) Int. Cl.[7] ..... B02C 1/10
(52) U.S. Cl. ..... 241/264
(58) Field of Search ..... 241/264–269, 241/30

(56) References Cited

U.S. PATENT DOCUMENTS 5,791,573 A 8/1998 Okuya

FOREIGN PATENT DOCUMENTS

| | | |
|---|---|---|
| EP | 919 283 | 6/1999 |
| JP | 6-106083 | 4/1994 |
| JP | 6-182238 | 7/1994 |

*Primary Examiner*—Mark Rosenbaum
(74) *Attorney, Agent, or Firm*—Westerman, Hattori, Daniels & Adrian, LLP

(57) ABSTRACT

The invention provides a cutter for a method of crushing and breaking casting products utilizing a casting product crushing and breaking apparatus and is constituted such that front end side mountain portions 44 and 54 are provided at front end sides of cutters 42 and 52 opposed to each other and bottom side mountain portions 43 and 53 are provided on bottom sides thereof. Therefore, there can be carried out operation of pressing useless casting products and operation of crushing and breaking thereof between the front end side mountain portions and the bottom side mountain portions provided at the respective cutters of one and other cutting apparatus. Useless casting products of long objects can be crushed and broken firmly and smoothly. Cutting dimensions are substantially made constant and by making the cutting dimensions substantially constant, melting operation can be made efficient.

3 Claims, 11 Drawing Sheets

CRUSHING-BREAKING METHOD OF CASTING PRODUCTS, CUTTER STRUCTURE USED FOR THE METHOD AND CRUSHING-BREAKING APPARATUS OF CASTING PRODUCTS

BACKGROUND OF THE INVENTION

1. Field of the Invention

The present invention relates to a method of crushing and breaking casting objects of long objects or the like, a structure of a cutter used for the method and crushing-breaking apparatus of casting products.

2. Description of the Related Art

The applicant discloses a method of crushing and breaking (breaking) of casting products of the title in Japan and the United States of America or Europe (referred to as outline (1). With regard to outline (1), there are disclosed Japanese Patent Laid-Open No.106083/1994 'An apparatus for crushing-breaking weirs, runners, failed products or the like for casting by hydraulic pressure', Japanese Patent Laid-Open No.182238/1994 'A method of crushing-breaking weirs, runners, failed products for casting comprising nonuniform objects, U.S. Pat. No. 5,791,573 'CRUSHING-BREAKING APPARATUS' and European Patent Laid-Open No.0919283 'An apparatus for crushing-breaking useless casting products using a fixed and a rocking cutter device and method for coating said cutting devices'.

According to outline (1), there are provided one and other cutter apparatus upper and lower faces of which are open, the one cutter apparatus is provided with a number of pieces of cutters in a mountain-like shape projected in a zigzag shape, the other cutter apparatus is provided with a number of pieces of cutters in a mountain-like shape projected in a zigzag shape and the other cutter apparatus is constituted movably. There is constructed a structure in which in retracting the other cutter apparatus, useless weirs and runners, useless products and the like (referred to as useless products) are charged from a charge opening formed between the one cutter apparatus and the other cutter apparatus and by bringing the cutters in the mountain-like shape of the other cutter apparatus and the cutters in the mountain-like shape of the one cutter apparatus into a fitting relationship, the useless casting products and the like are crushed and broken and extraction and retraction of the other movable cutter apparatus are automatically controlled by utilizing a cylinder. Further, the broken casting products (casting products to be recycled) are discharged to outside of the apparatus from a discharge opening on the lower side of the apparatus.

Further, the applicant discloses a movable cutter apparatus used in a method of crushing (breaking) casting products in Japan and the United States of America (referred to as outline (2). With regard to outline (2), there are disclosed Japanese Patent Laid-Open No.106083/1994 'A crushing-breaking apparatus of weirs, runners, failed products or the like for casting by hydraulic pressure' and U.S. Pat. No. 5,791,573 'Crushing-Breaking apparatus'.

According to outline (2), there is constructed a constitution in which a strip-like bottom movable cutter apparatus is provided at a discharge opening on a lower side of one and other cutter apparatus. According to the strip-like bottom movable cutter apparatus, in retracting the other cutter apparatus, useless products or casting products to be recycled charged from a charge opening between the other cutter apparatus and the one cutter apparatus, are prevented from dropping.

According to outline (1), as shown by schematic views of FIGS. 12(*a*) and 12(*b*) indicating extracting movement of the other cutter apparatus, a bottom side of a cutter of the one cutter apparatus is formed in a planar shape. Further, an upper side of a cutter of the other cutter apparatus is formed in a curved shape. Therefore, when a long object is present between the planar shape on the bottom side and the curved shape on the upper side, there is exerted press force or impact force (referred to as impact force) substantially in the form of face contact, there is a concern that a deficiency in impact force is caused, the object is not broken firmly and smoothly, or the object is escaped and sandwiched between the planar shape on the bottom side and the curved shape on the upper side and is difficult to process, or there poses a problem of damaging the cutter or shortening the life, or there poses a problem of deteriorating the operational efficiency or a problem in view of safety and in view of operational control. Further, as shown by schematic views of FIGS. 12(*c*) and 12(*d*) indicating forward movement of the other cutter apparatus, a front end side of a cutter of the one cutter apparatus is formed in a planar shape. Further, also a front end side of a cutter of the other cutter apparatus is formed in a planar shape. Therefore, useless casting objects are exerted with impact force by face contact produced by the two planar shapes and therefore, there poses a problem in which a deficiency in impact force is caused, the useless casting products cannot be broken firmly and smoothly, or the useless casting products are escaped and dropped from between the two planar shapes. Particularly, the tendency is intensified in a large-sized crushing-breaking apparatus, which is a problem to be improved.

Further, according to outlines (1) and (2), it is not intended to operate a charge opening and/or a discharge opening formed at a base end portion on a side of a fulcrum point shaft (support shaft) of the one cutter apparatus and the other cutter apparatus in correspondence with maintenance control of a breaking mechanism, relieving of clogging, change of kind of material and size of charged casting products and breaking dimension and therefore, there is a concern that it is difficult to deal with a failure of the apparatus or interchange the cutter apparatus.

SUMMARY OF THE INVENTION

An explanation will be given of a method of crushing and breaking casting products and a cutter structure used for the method shown in FIG. 1 through FIG. 8. Useless casting products are charged into a charge opening formed by opening upper sides of cutter bases of other cutter apparatus and opening upper sides of cutter bases of one cutter apparatus in a situation in which the other cutter apparatus is disposed at a retracting limit. Further, in charging the useless casting products, according to a structure installed with a movable cutter apparatus, by utilizing recesses and projections of the cutter bases, long objects can be prevented from dropping. Thereafter, the other cutter apparatus carries out extracting movement along a circular arc track and at the occasion, there is brought about a relationship in which the cutters for carrying out the extracting movement along the circular arc track and opposed cutters are fitted together to thereby carry out crushing and breaking operation. For example, useless casting products of long objects are firmly crushed and broken by crushing and breaking force by a fitting relationship between bottom side mountain portions of bottom sides of pressing cutters and bottom side mountain portions of bottom sides of receiving cutters, that is, by bending force in an up and down direction. Further, by press down force (pressing stress) by front end side mountain portions on front end sides of the pressing cutters and front end side mountain portions of front end sides of the receiving cutters, the casting product crushing and breaking apparatus carries out the extracting movement to a lower side and there is exerted crushing and breaking force by the fitting relationship between the front end side mountain portions of the pressing cutters and the front end side mountain portions of the receiving cutters to thereby firmly crush and break the useless casting products. Further, the front end side mountain portion of the pressing cutter and the front end side mountain portion of the receiving cutter are formed by shapes projected to the front end sides and carry out pressing operation as the front end side mountain portions for preventing scattering. Therefore, the casting products or crushed and broken casting products do not carry out extracting movement to an upper side and a safe and efficient processing is achieved. Further, the force of crushing and breaking the useless casting products or the crushed and broken casting products, is concentrated to the bottom side mountain portion and the front end side mountain portion and therefore, there is achieved a merit useful for crushing and breaking the casting products firmly and by low pressure force, or down sizing of cylinders or a total of apparatus, or a reduction in running cost or the like.

Thereafter, by the extracting movement of the other cutter apparatus, there are carried out pressing and crushing and breaking (shearing between cutters) by the cutters (between cutters) or pressing and crushing and breaking by the front end side mountain portions for preventing scattering.

Further, the casting products to be recycled are successively received by lower cutters while dropping in clearances among the cutters or reach clearances among successive cutters. Thereafter, the pressing and crushing and breaking as well as dropping are pertinently repeated and the useless casting products are contained in, for example, a containing portion on a lower side from a charge opening (discharge opening) formed by the clearances among the cutters of the one and other cutter apparatus or by opening the lower sides of the cutter bases. Further, according to the structure installed with the movable cutter apparatus, the discharge opening is opened by moving the movable cutter apparatus (extracting movement) in discharging.

Further, the other cutter apparatus may also be constructed by a constitution in which the other cutter apparatus carries out not only the extracting movement but also carries out the extracting movement again after the extracting and retracting movement once when load is applied on the other cutter apparatus in the extracting movement. Further, the other cutter apparatus carries out the extracting movement after reaching an extracting limit. In the extracting movement, when load is applied on the other cutter apparatus, an operation similar to that of the above-described example is carried out.

An explanation will be given of crushing-breaking apparatus of casting products shown in FIG. 9 through FIG. 11.

When a charge opening and/or discharge opening (referred to as charge opening or the like) are brought into an opened state or dimensions thereof are changed, the other apparatus is supported by using means such as a crane or supporting means (hereinafter, referred to as crane), there is carried out an operation of drawing and/or an operation of inserting support blocks in frame holes and by utilizing movement of support bearings and changing numbers of support blocks, a dimension of the charge opening is changed or an opening degree of the charge opening is adjusted. Further, structures of cutters of the one and other cutter apparatus differ from those of the above-described cutters and the bottom side mountain portion and the front end side mountain portion are flattened. Naturally, the above-described cutters of FIG. 1 through FIG. 8 can also be adopted.

Further, the support bearing is moved automatically by utilizing a cylinder and in order to ensure accuracy of movement, detecting means such as sensors are arranged. After the movement, by setting the support bearing, the position is determined and therefore, the support state is released. Further, after the movement, when repair is carried out after setting the support bearing, the operation is carried out in the support state with an intention of ensuring the safety. When the support bearing is moved, by pivoting movable means such as cylinder, distance is adjusted, or smooth and firm movement is achieved.

DETAILED DESCRIPTION OF PREFERRED EMBODIMENTS

Figure 1:
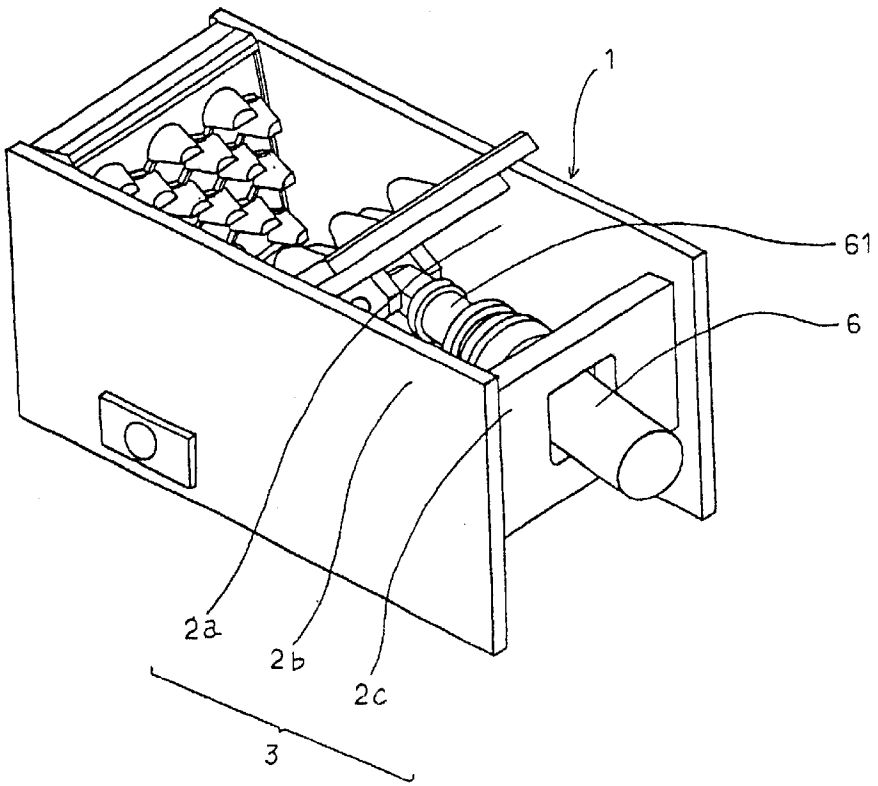
FIG. 1 is a perspective view of a total of a crushing-breaking apparatus used in the invention.
Figure 2:
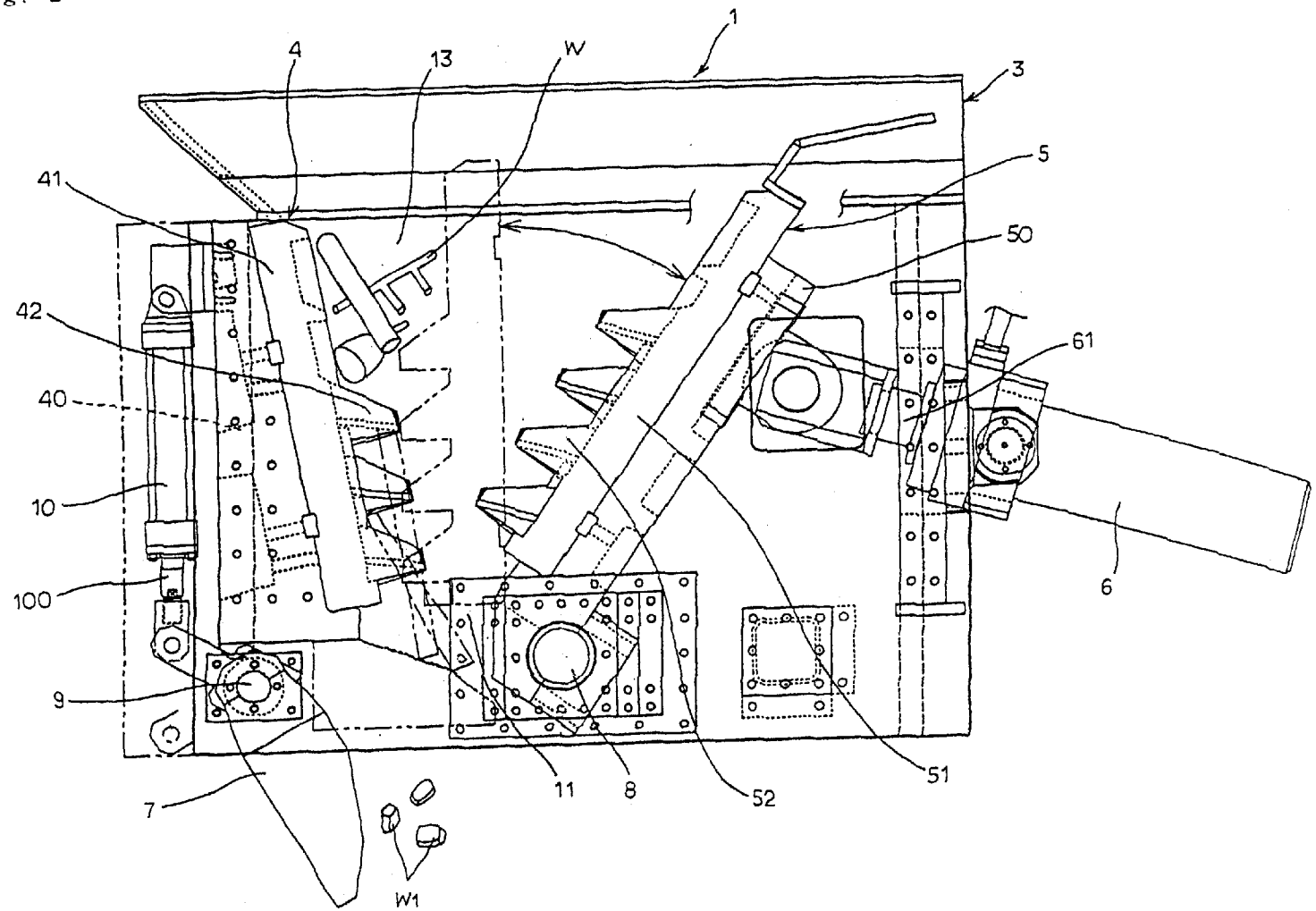
FIG. 2 is a sectional view of FIG. 1.
Figure 3:
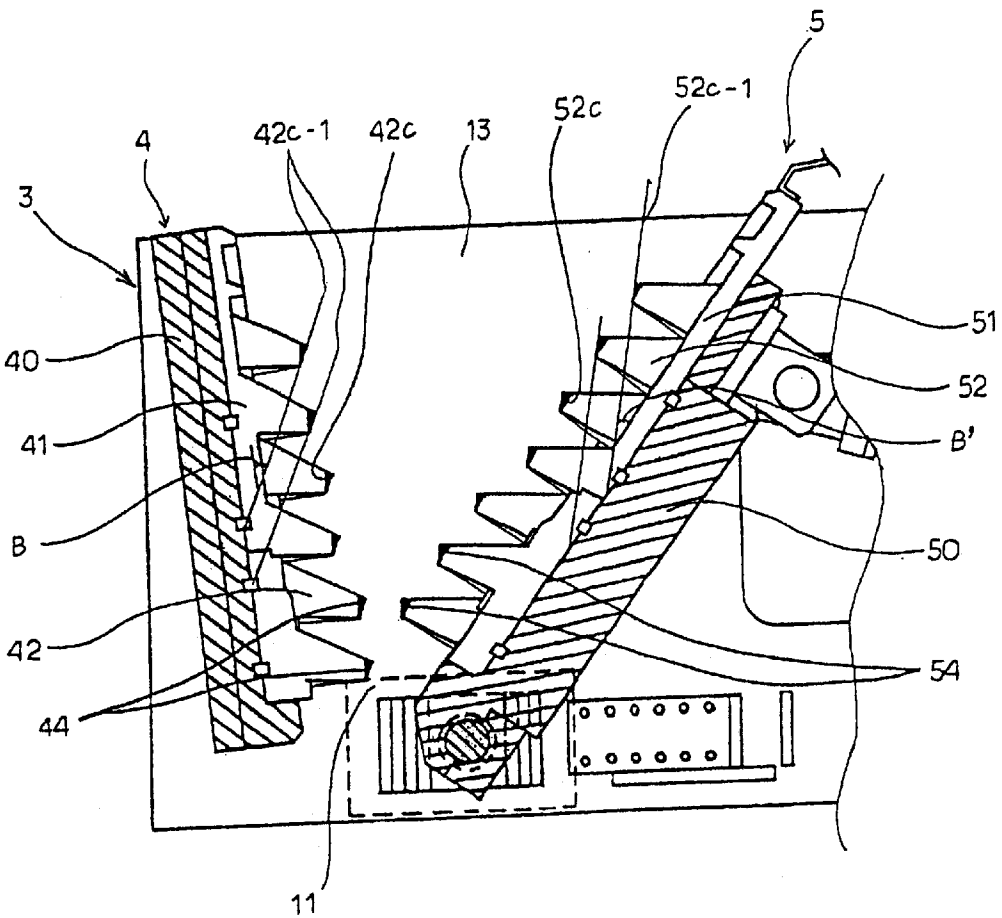
FIG. 3 is a sectional view of other crushing-breaking apparatus used in the invention.
Figure 5:
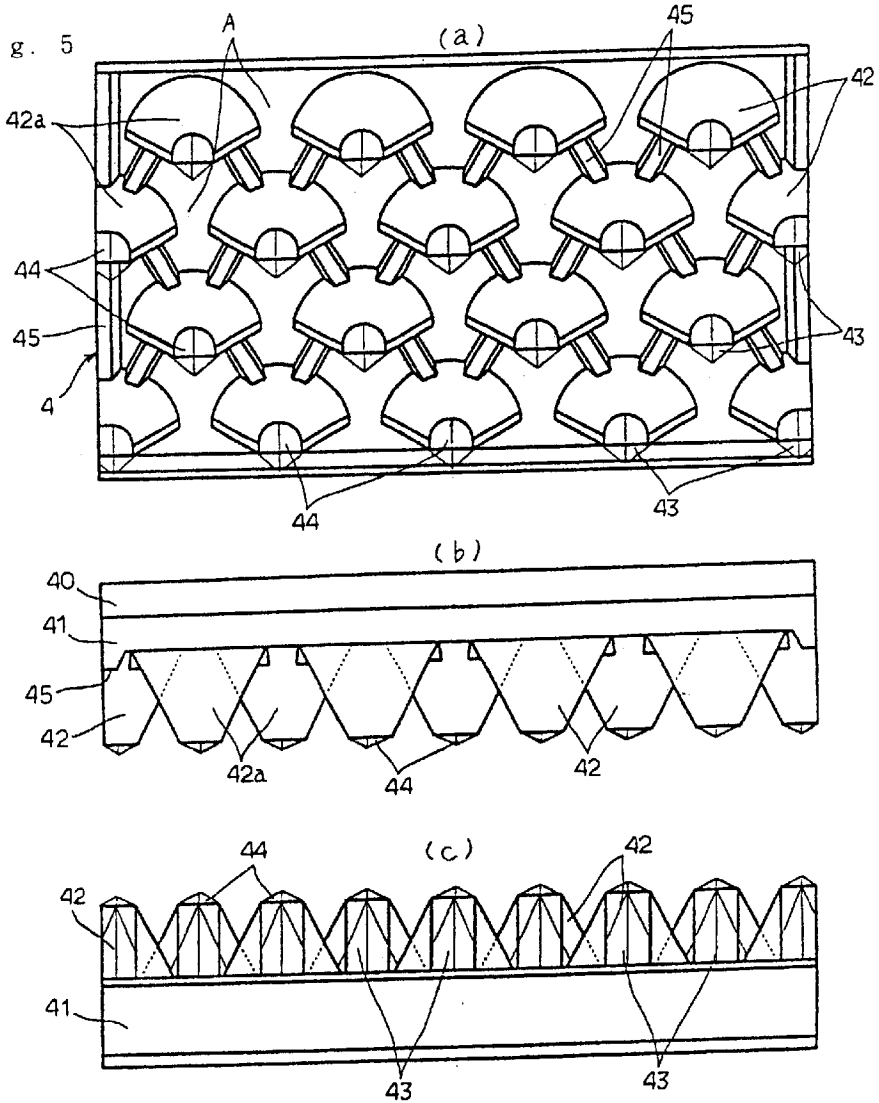
FIGS. 5(*a*), 5(*b*) and 5(*c*) are views showing one cutter apparatus in which FIG. 5(*a*) is an enlarged front view, FIG. 5(*b*) is an enlarged plane view and FIG. 5(*c*) is an enlarged bottom view.
Figure 4:
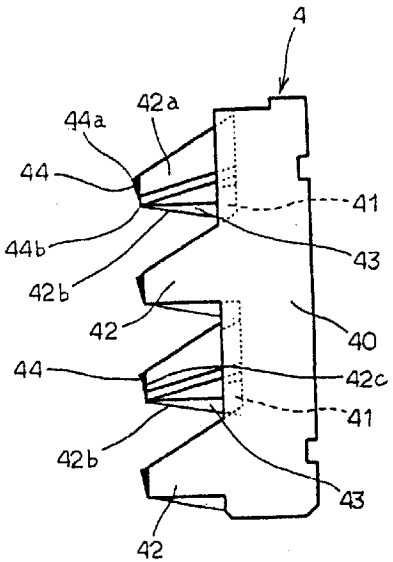
FIG. 4 is an enlarged side view of one cutter apparatus.
Figure 7:
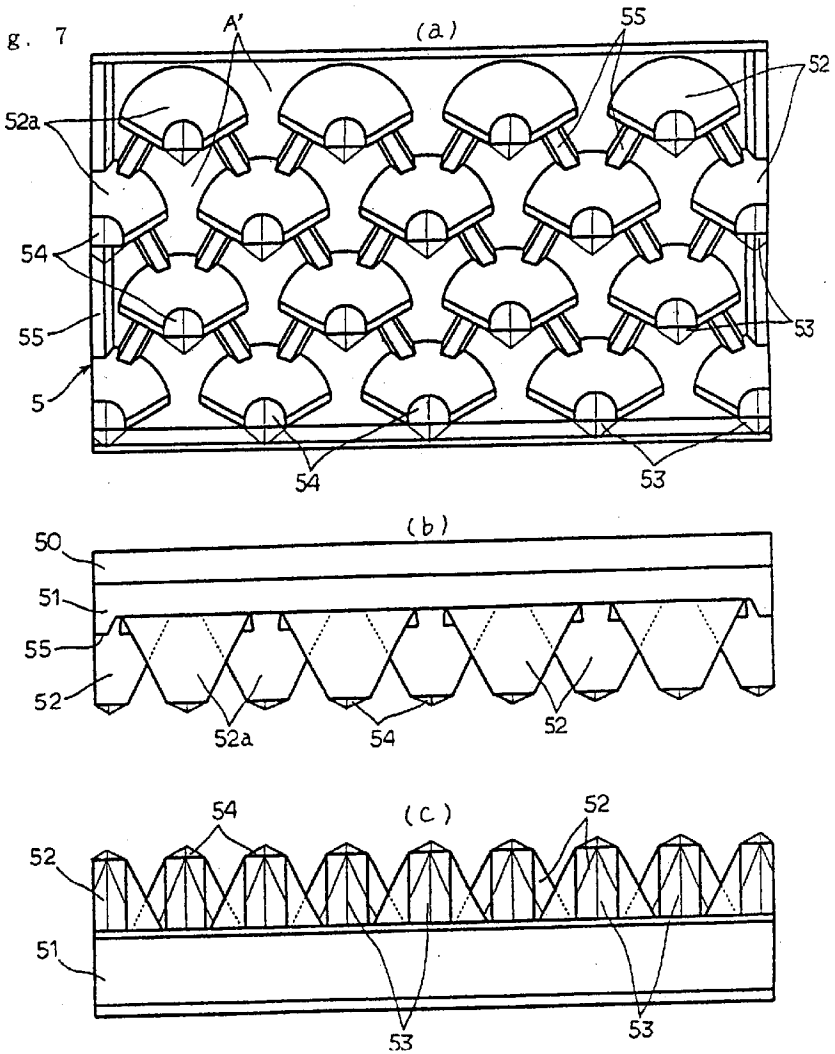
FIGS. 7(*a*), 7(*b*) and 7(*c*) are views showing other cutter apparatus in which FIG. 7(*a*) is an enlarged front view, FIG. 7(*b*) is an enlarged plane view and FIG. 7(*c*) is an enlarged bottom view.
Figure 6:
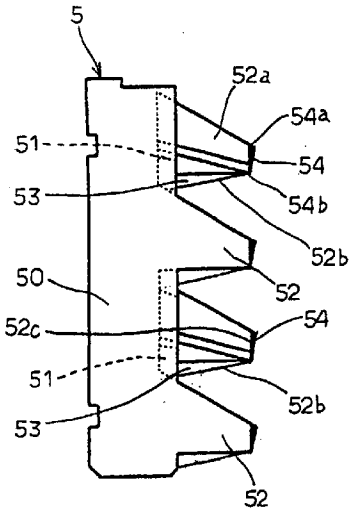
FIG. 6 is an enlarged side view of other cutter apparatus.
Figure 8:
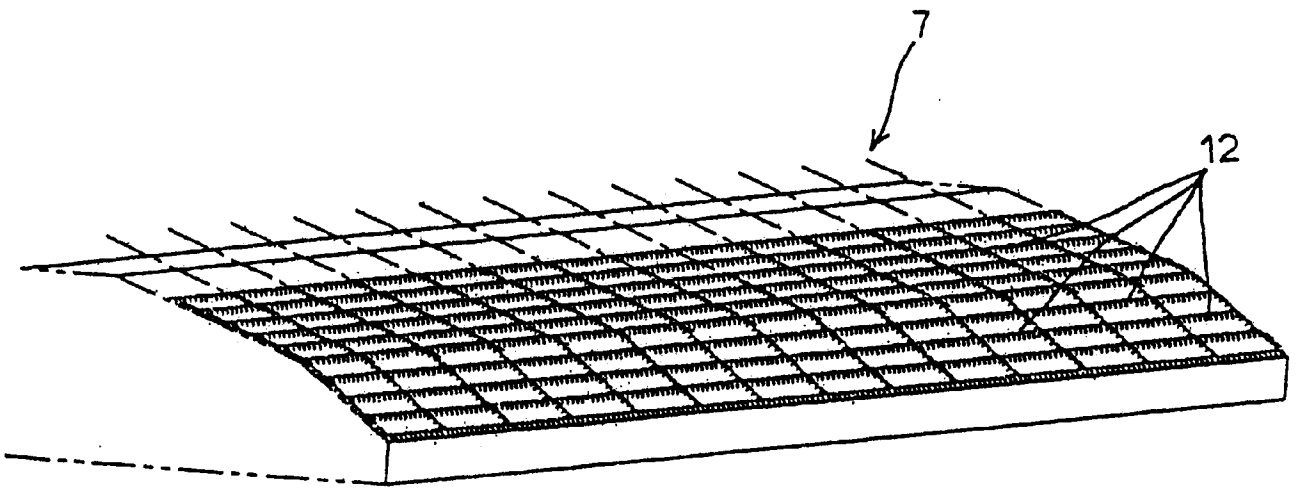
FIG. 8 is an enlarged perspective view showing a movable cutter apparatus.
Figure 9:
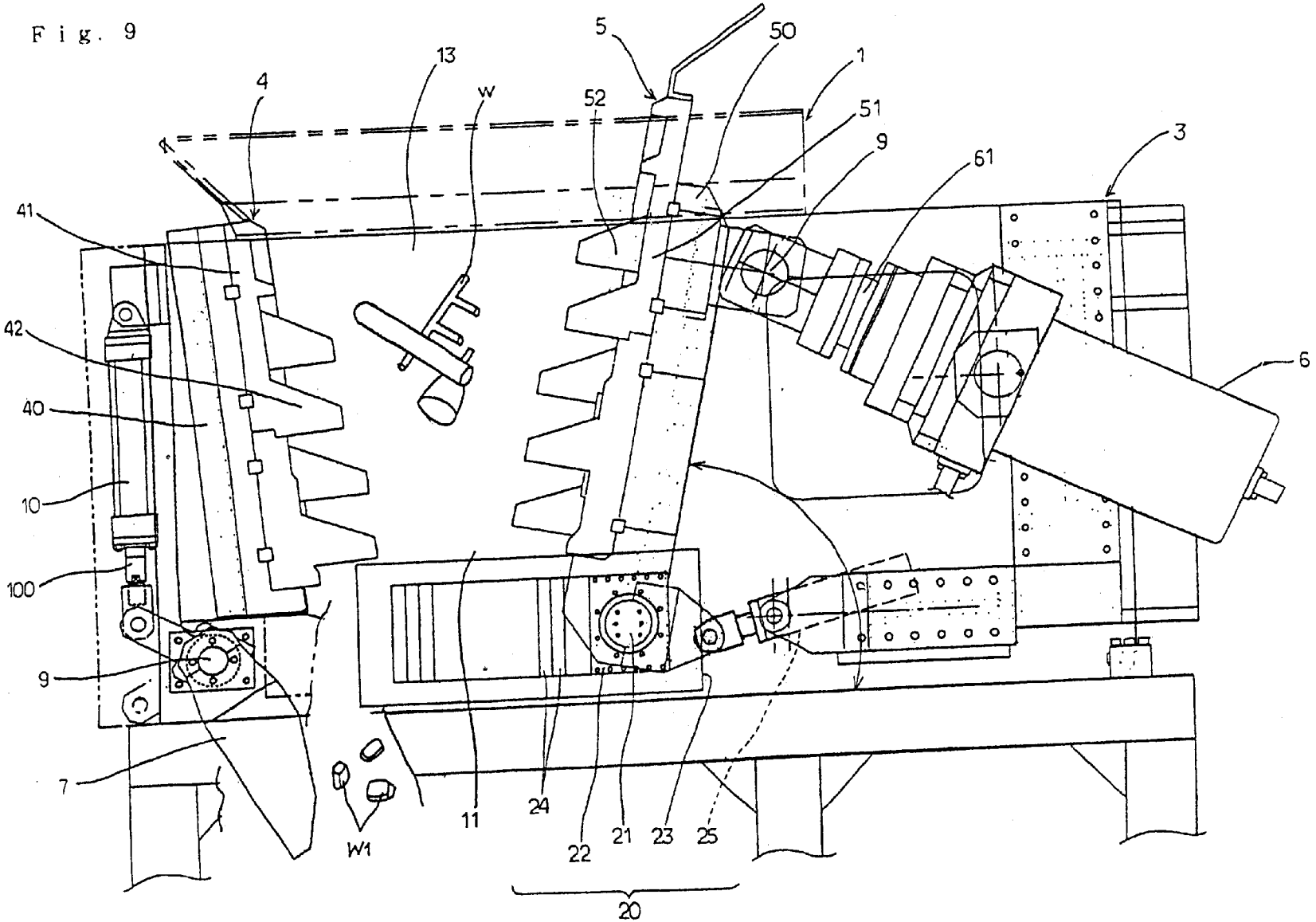
FIG. 9 is a sectional view of other crushing-breaking apparatus according to the invention.
Figure 10:
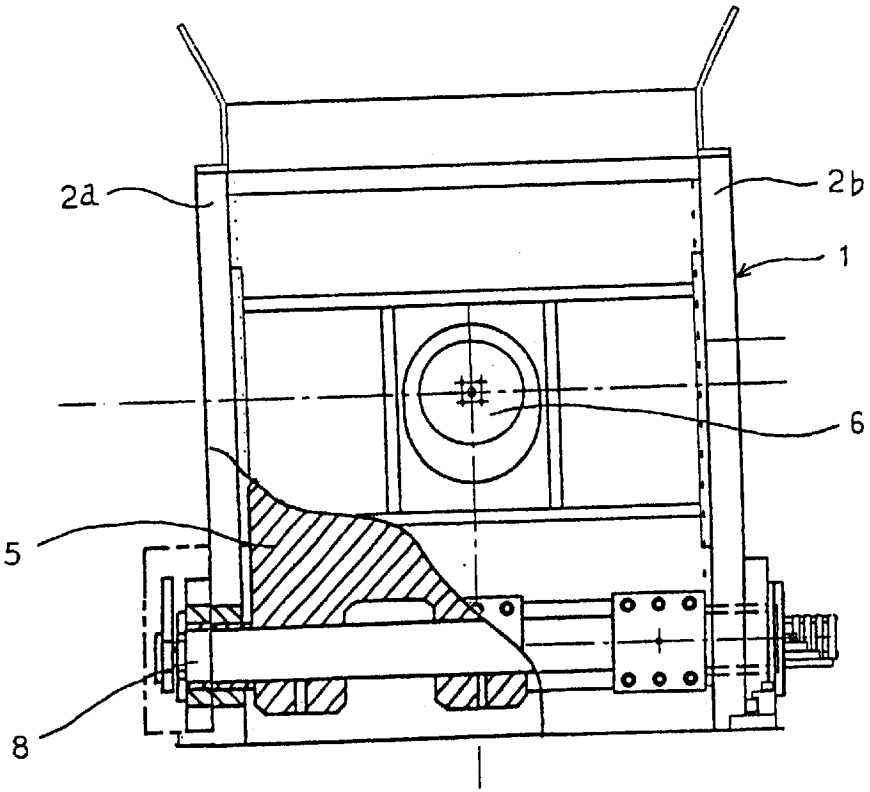
FIG. 10 is a sectional view showing a relationship between a crushing-breaking apparatus and a support apparatus of other cutter apparatus.
Figure 11:
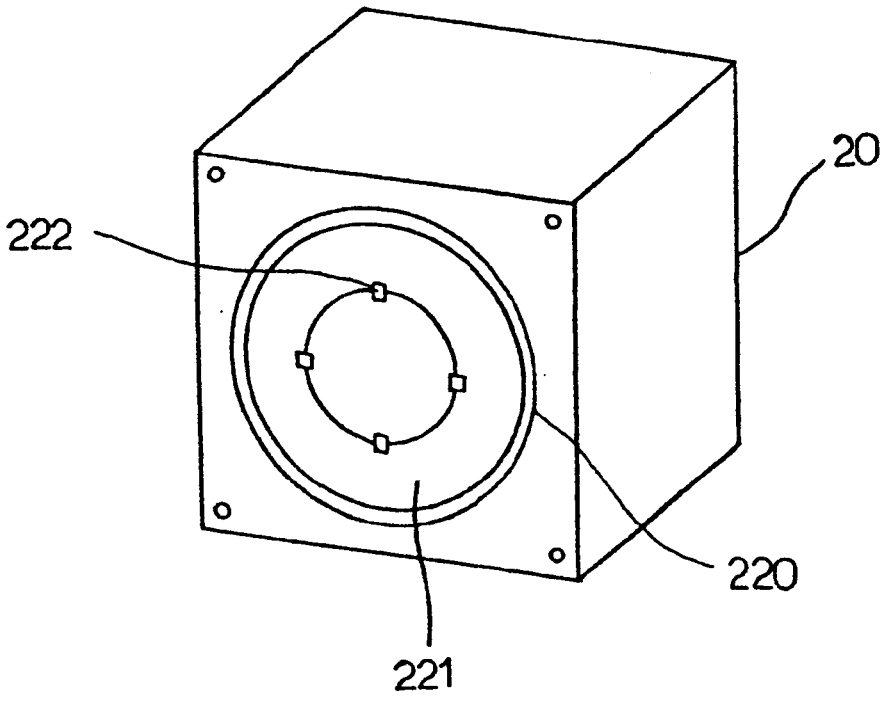
FIG. 11 is a side view cutting essential portions.
Figure 12:
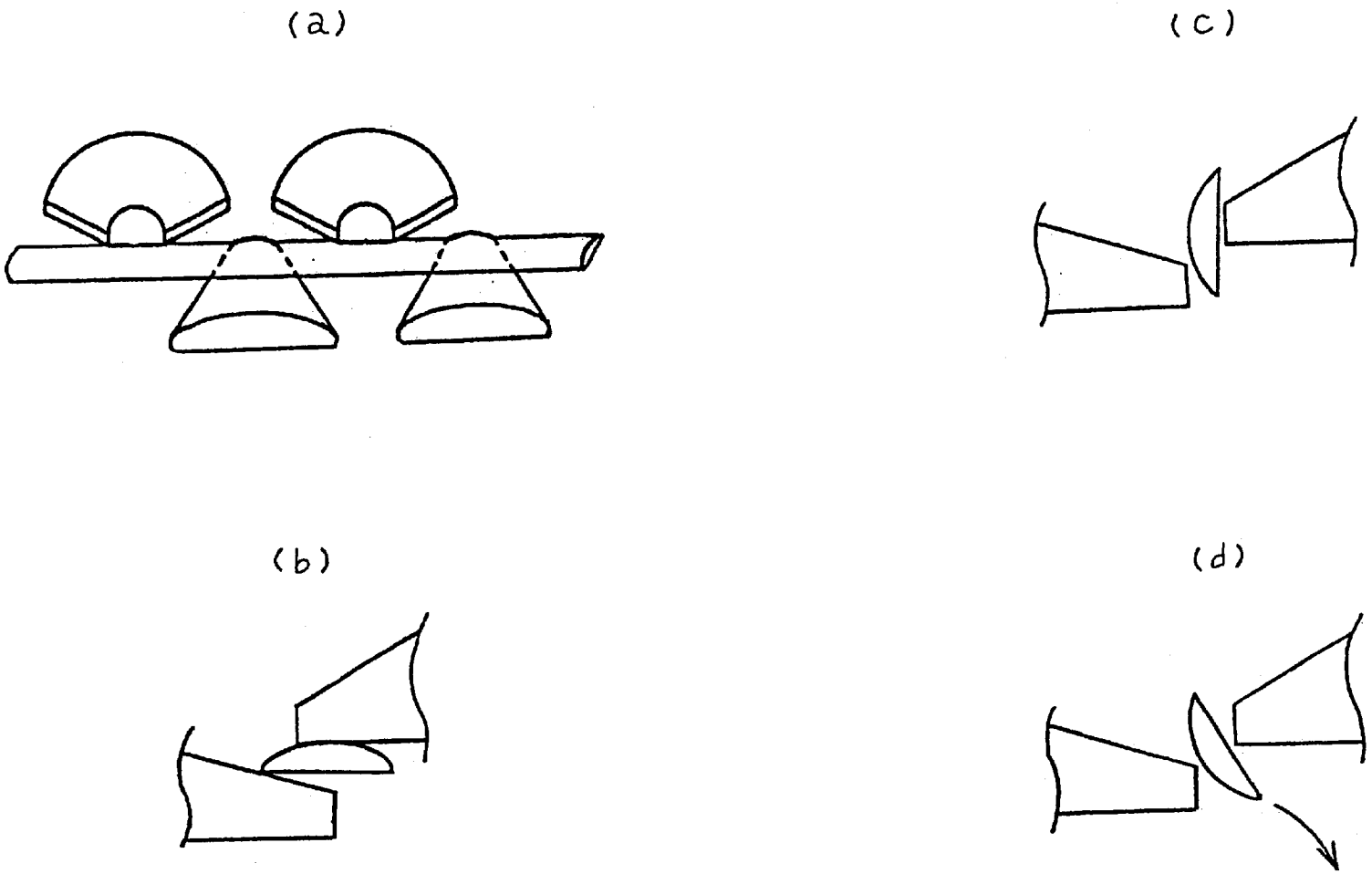
Fig. 12 PRIOR ART
FIGS. 12(*a*), 12(*b*), 12(*c*) and 12(*d*) are views showing states of operating conventional one and other cutter apparatus in which FIG. 12(*a*) is an enlarged schematic view for explaining a relationship between long objects and cutters, FIG. 12(*b*) is a side view of FIG. 12(*a*), FIG. 12(*c*) is an enlarged schematic view for explaining a relationship between a casting product and cutters and FIG. 12(*d*) is an enlarged schematic view showing movement successive to FIG. 12(*c*)
Figure 13:
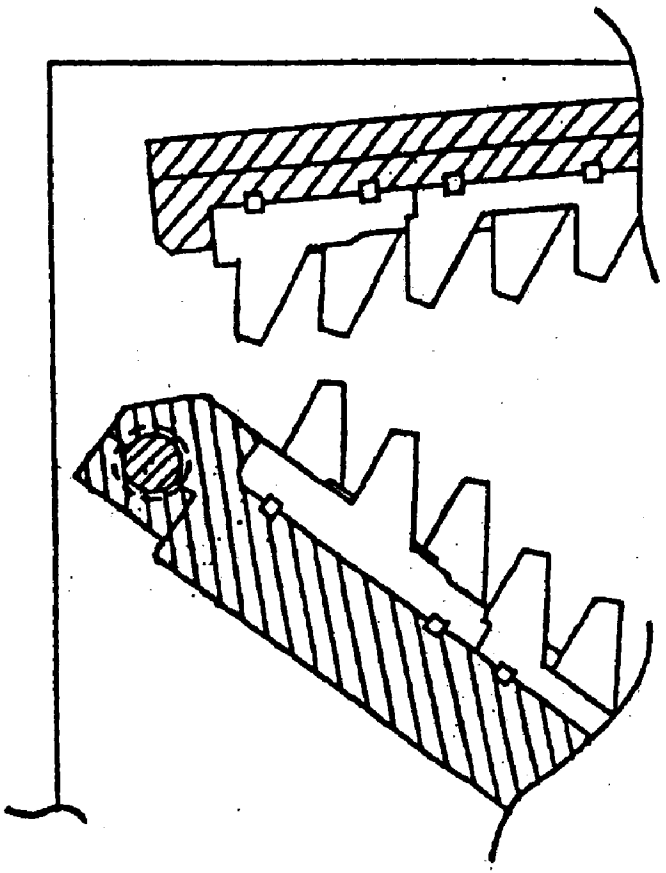
Fig. 13 PRIOR ART
FIG. 13 is an enlarged schematic view for explaining a relationship between cutters of conventional one and other cutter apparatus.

One explanation will be given of an example of a crushing-breaking apparatus used in a method according to the invention in reference to the drawings as follows. The crushing-breaking apparatus 1 is provided with a frame 3 which is constituted by side plates 2*a* and 2*b* and a cross plate 2*c* and upper and lower sides of which are open, one cutter apparatus 4 and other cutter apparatus 5 provided to the frame 3, a cylinder 6 for extracting and retracting the other cutter apparatus 5 and a movable cutter apparatus 7 as principal constitute elements.

The one cutter apparatus 4 is constituted by a base plate 40 for attaching a cutter base provided at the frame 3, cutter bases 41 attachably and detachably provided to the base plate 40 and a number of pieces of cutters 42 for crushing and breaking in a shape of a half truncated circular cone provided to the cutter bases 41 in a zigzag shape. A curved inclined face 42*a* of the cutter 42 in the shape of the half truncated circular cone is provided with an inclination by which crushed and broken casting products can firmly and naturally drop. The cutters 42 are arranged in the zigzag shape, among the cutters 42, there are formed spaces A capable of fitting cutters 52 in a shape of a half truncated circular cone of the other cutter apparatus 5, mentioned later, and the cutters 52 of the other cutter apparatus 5, mentioned later, are fitted to the spaces A. The crushed and broken casting products drop in fitting clearances formed by the cutter 52 of the other cutter apparatus 5 fitted to the spaces 4 and the cutters 42 of the one cutter apparatus 4. In the drawing, numeral 43 designates a bottom side mountain portion projected to a bottom side 42*b* in a mountain-like shape and the bottom side mountain portion 43 efficiently crushes and breaks useless casting products w and prevents crushed and broken casting products w1 from being sandwiched between the cutter 42 and/or the cutter 52. In the drawing, numeral 44 designates a front end side mountain portion for preventing scattering provided on a front end side 42*c* and the front end side mountain portion 44 is constituted such that a cutter front end side upper 44*a* of the front end side 42*c* is projected relative to a cutter front end side lower 44*b* of the front end side 42*c*. Further, there is constructed a constitution in which an imaginary extension 42*c*-1 extended from the front end side 42*c* of the cutter 42 of the one cutter apparatus 4 intersects with the face of the cutter base 41 by an acute angle B. As a result of adopting the constitution there is provided a characteristic of preventing the crushed and broken casting products w1 from scattering and pressing (press stress) the crushed and broken casting products w1 to a lower side of the casting product crushing and breaking apparatus and breaking (break force) the crushed and broken casting products simultaneously therewith. In the drawing, numeral 45 designates rib-shaped cutters for crushing and breaking provided among the cutters 42.

The other cutter apparatus 5 is constituted by an extracting movement plate 50 provided pivotably to the frame 3 via a pivoting shaft 8, cutter bases 51 provided attachably and detachably to the extracting movement plate 50 and a number of pieces of cutters 52 (pressing cutter) for crushing and breaking in the shape of the half truncated circular cone provided to the cutter bases 51 in a zigzag shape. A curved inclined face 52*a* of the cutter 52 in the shape of the half truncated circular cone, is provided with an inclination by which the crushed and broken casting products W1 drop firmly and naturally. The cutters 52 are arranged in the zigzag shape and the cutters 42 in the shape of the half truncated circular cone of the one cutter apparatus 4 are fitted with spaces A' among the cutters 52. In the drawing, numeral 53 designates a bottom side mountain portion projected to a bottom side 52*b* in a mountain-like shape and the bottom side mountain portion 53 efficiently crushes and breaks the useless casting products W and prevents the crushed and broken casting products W1 from beings sandwiched between the cutter 42 and/or the cutter 52, which is particularly effective in crushing and cutting a long object. In the drawing, numeral 54 designates a front end side mountain portion for preventing scattering provided at a front end side 52*c* and the front end side mountain portion 54 is constructed by a constitution in which a cutter front end side upper 54*a* of the front end side 52*c* is projected relative to a cutter front end side lower 54*b* of the front end side 52*c*. Further, there is constructed a constitution in which an imaginary extension 52*c*-1 extended from the front end side 52*c* of the cutter 52 of the other cutter apparatus 5 intersects with the face of the cutter base 51 by an acute angle B'. As a result of adopting the constitution, for example, there is provided a characteristic of preventing the crushed and broken casting products W1 from being scattered, pressing the crushed and broken casting products W1 to the lower side of the casting product crushing and breaking apparatus and crushing and breaking thereof simultaneously therewith. In the drawing, numeral 55 designates rib-shaped cutters for crushing and breaking provided among the cutters 52.

According to the other cutter apparatus 5, the other cutter apparatus 5 is extracted and retracted (extracting movement) with the pivoting shaft 8 as a support shaft via extraction and contraction of a piston rod 61 of the cylinder 6. That is, the cutters 52 on a side of extracting movement are brought into contact and separated from the cutters 42 on a fixed side, the piston rod 61 is pivotally attached to an upper side of the extracting movement plate 50 and therefore, a lever movement mechanism is constituted by the pivoting shaft 8 (fulcrum) and the upper position pivotally attached with the piston rod 61 and the extracting movement plate 50 is applied with pressing by the lever movement mechanism.

The movable cutter apparatus 7 is movably provided by a pivoting shaft 9 on a lower side of the one cutter apparatus 4 and the movement is carried out by utilizing a cylinder 10. For example, there is constructed a constitution in which a discharge opening 11 is closed by extracting a piston rod 100 of the cylinder 10 and by retracting the piston rod 100 of the cylinder 10, there is opened the discharge opening 11 formed by opening the lower side of the cutter bases 41 of the one cutter apparatus 4 and opening the lower side of the cutter bases 51 of the other cutter apparatus 5. Further, the surface of the movable cutter apparatus 7 is provided with welded ribs 12 for preventing the useless casting products W from being slipped. Further, the welded rib 12 is characterized in being useful for promoting wear resistance and strength.

Further, in the drawing, numeral 13 designates a charge opening formed by opening the upper side of the cutter bases 41 of the one cutter apparatus 4 and opening the upper side of the cutter bases 51 of the other cutter apparatus 5 and the useless casting products W are charged from the charge opening 13.

An explanation will be given here of a state of operating the one cutter apparatus 4 and the other cutter apparatus 5. There is constructed a constitution in which the charge opening 13 in a V-like shaped zone is formed at opposed faces of the cutter bases 41 of the one cutter apparatus 4 and the cutter bases 51 of the other cutter apparatus 5, the useless casting products w are charged into the charge opening 13 and thereafter, the charge opening 13 is compressed or expanded. The useless casting products w or the crushed and broken casting products w1 are crushed and broken and the useless casting products w or the crushed and broken casting products w1 are prevented from scattering by utilizing an operation of crushing and breaking the useless casting products w by the extracting movement of the other cutter apparatus 5 and the fitting relationship between the cutters 52 in the shape of the half truncated circular cone of the other cutter apparatus 5 and the cutters 42 in the shape of the half truncated circular cone of the one cutter apparatus 4 and operation of pressing the casting products to the lower side of the casting product crushing and breaking apparatus by the front end sides 52*c* of the cutters 52 and the front end sides 42*c* of the cutters 42. By the above-described operation, the crushed and broken casting products w1 are guided to the discharge opening 11 of the casting product crushing and breaking apparatus and discharged outside of the casting product crushing and breaking apparatus from the discharge opening 11.

Next, a support apparatus 20 for supporting the other cutter apparatus 5 is constituted by a support shaft 21, support bearings 22 for receiving the support shaft 21, frame holes 23 perforated at the side plates 2*a* and 2*b* of the frame 3 inserted with the support bearings 22 and support blocks 24 inserted into the frame holes 23. Therefore, the position of the support shaft 21 can be changed by adjusting numbers of the left and right support blocks 24 in the frame holes 23 by utilizing drawing and inserting the support blocks 24 fitted to the frame holes 23. In the drawing, numeral 25 designates means such as a cylinder for governing movement of the support bearing 22. Further, the support bearing 22 is provided with a metal 220, a bush 221 and a key 222.

A first aspect of the invention is characterized in that the operation of pressing and the operation of crushing and breaking useless casting products are carried out between the front end side mountain portions and the bottom sides mountain portions provided at the respective cutters of the one and the other cutter apparatus and therefore, useless casting products of long objects are crushed and broken firmly and smoothly, the crushing and breaking dimensions are made substantially constant and by making the crushing and breaking dimensions substantially constant, efficient formation of melting (firm, smooth and speedy melting) is achieved.

A second aspect of the invention is characterized in that in addition to the effect of the first aspect, after firmly receiving useless casting products of long objects, the useless casting products can be crushed and broken firmly and smoothly and the crushing and breaking dimensions can be made substantially constant.

A third aspect of the invention can provide cutters of the one and the other cutter apparatus capable of achieving the effects of the first and second aspects.

A fourth aspect of the invention achieves a merit such that the dimension of the charge opening and/or the discharge opening formed at the one and the other cutter apparatus can easily be adjusted and can arbitrarily adjusted in correspondence with maintenance control of the crushing-breaking apparatus, release of clogging, change of material, such as size or crushing and breaking dimension of charged casting products, further, promotion of safety of the crushing-breaking apparatus, can be carried out and when the crushing-breaking apparatus is set on the basis of other apparatus, repair, welding or release of clogging can be carried out from lower side.

A fifth aspect of the invention can provide a support apparatus of the other cutter apparatus capable of achieving the effect of the fourth aspect.

Drawings

FIG. 1

1. CRUSHING-BREAKING APPARATUS
2*a*. SIDE PLATE
2*b*. SIDE PLATE
2*c*. CROSS PLATE
3. FRAME.
6. CYLINDER
61. PISTON ROD

FIG. 2

4. ONE CUTTER APPARATUS.
5. OTHER CUTTER APPARATUS
7. MOVABLE CUTTER APPARATUS
8. PIVOTING SHAFT
9. PIVOTING SHAFT
10. CYLINDER
11. DISCHARGE OPENING
13. CHARGE OPENING
40. BASE PLATE
41. CUTTER BASE
42. CUTTER
50. MOVING PLATE
51. CUTTER BASE
52. CUTTER
100. PISTON ROD
W. USELESS CASTING PRODUCTS
W1. CRUSHED AND BROKEN CASTING PRODUCTS,

FIG. 3

44. FRONT END SIDE MOUNTAIN PORTION
42*c*. FRONT END SIDE
42*c*-1. IMAGINARY EXTENSION.
52*c*. FRONT END SIDE
52*c*-1. IMAGINARY EXTENSION
54. FRONT END SIDE MOUNTAIN PORTION
B. ACUTE ANGLE
B'. ACUTE ANGLE

FIG. 4

42*a*. INCLINED FACE
42*b*. BOTTOM SIDE
43. BOTTOM SIDE MOUNTAIN PORTION.
44*a*. UPPER SIDE
44*b*. LOWER SIDE

FIG. 5

45. RIB-SHAPED CUTTER.
A. SPACE

FIG. 6

52*a*. INCLINED FACE.
52*b*. BOTTOM SIDE
53. BOTTOM SIDE MOUNTAIN PORTION
54*a*. UPPER SIDE
54*b*. LOWER SIDE

FIG. 7

55. RIB-SHAPED CUTTER.
A'. SPACE

FIG. 8

12. WELDED RIB.

FIG. 9

21. SUPPORT SHAFT
22. SUPPORT BEARING
23. FRAME HOLE
25. MEANS
27. SUPPORT BLOCK

FIG. 11

220. METAL.
221. BUSH
222. KEY

What is claimed is:

1. A method of crushing and breaking casting products for crushing and breaking useless casting products by utilizing front end side mountain portions and bottom side mountain portions provided at cutters of one cutter apparatus, front end side mountain portions and bottom side mountain portions provided at cutters of other cutter apparatus opposed to the one cutter apparatus, an extracting movement by a circular arc track of at least the other cutter apparatus and a fitting relationship between the front end side mountain portions and the bottom side mountain portions of the two cutters, said method comprising:

(1) a step of processing casting products to be recycled by utilizing a pressing operation of the useless casting products by the front end side mountain portions and the bottom side mountain portions of the cutters and a crushing and breaking operation by fitting together the front end side mountain portions and the bottom side mountain portions of the two cutters by the extracting movement of the cutters of at least the other cutter apparatus;

(2) a step of dropping the casting products to be recycled toward a lower side of the one and other cutter apparatus by a retracting movement by the circular arc track of at least the other cutter apparatus; and (3) a step of discharging the dropped casting products to be recycled by opening a discharge opening provided at the one and other cutter apparatus.

2. A method of crushing and breaking casting products for crushing and breaking useless casting products by utilizing front end side mountain portions and bottom side mountain portions provided at cutters of one cutter apparatus, front end side mountain portions and bottom side mountain portions provided at cutters of other cutter apparatus opposed to the one cutter apparatus, an extracting movement by a circular arc track of at least the other cutter apparatus and a fitting relationship between the front end side mountain portions and the bottom side mountain portions of the two cutters and prevention of the useless casting products from being dropped by using a movable cutter apparatus provided on a lower side of the one cutter apparatus, said method comprising:

(1) a step of preventing the useless casting products from being dropped by using movable cutter apparatus;

(2) a step of processing casting products to be recycled by utilizing a pressing operation of useless casting products by the front end side mountain portions and the bottom sides mountain portions of the cutters and a crushing and breaking operation by fitting together the front end side mountain portions and the bottom side mountain portions of the two cutters by the extracting movement of the cutters of at least the other cutter apparatus;

(3) a step of dropping the casting products to be recycled toward a lower side of the one and other cutter apparatus by a retracting movement by the circular arc track of at least the other cutter apparatus; and (4) a step of discharging the dropped casting products to be recycled by opening a discharge opening provided at the one and other cutter apparatus.

3. A method of crushing and breaking casting products according to claim 1 or claim 2:

(1) wherein at least one of the cutters are constructed by a constitution in which the front end side mountain portion is provided at a front end side of the cutter and the bottom side mountain portion is provided at a bottom side thereof.

* * * * *